US006641473B2

(12) United States Patent
Nakagawa et al.

(10) Patent No.: US 6,641,473 B2
(45) Date of Patent: Nov. 4, 2003

(54) GRINDING WHEEL WITH ABRASIVE SEGMENT CHIPS INCLUDING AT LEAST TWO ABRASIVE SEGMENT CHIPS WHOSE CIRCUMFERENTIAL LENGTHS ARE DIFFERENT FROM EACH OTHER

(75) Inventors: Toshimichi Nakagawa, Nagoya (JP); Koji Ogawa, Nagoya (JP); Kazumasa Yoshida, Niwa-gun (JP)

(73) Assignee: Noritake Co., Ltd., Nagoya (JP)

( * ) Notice: Subject to any disclaimer, the term of this patent is extended or adjusted under 35 U.S.C. 154(b) by 0 days.

(21) Appl. No.: 10/080,686

(22) Filed: Feb. 25, 2002

(65) Prior Publication Data

US 2002/0119742 A1 Aug. 29, 2002

(30) Foreign Application Priority Data

Feb. 28, 2001 (JP) ..... 2001-053927

(51) Int. Cl.[7] ..... B23F 21/03; B28D 1/04
(52) U.S. Cl. ..... 451/542; 451/544; 125/15
(58) Field of Search ..... 451/542, 543, 451/541, 540, 544, 547; 125/13.01, 15

(56) References Cited

U.S. PATENT DOCUMENTS 5,079,875 A * 1/1992 Unno et al. ..... 451/541
5,495,844 A * 3/1996 Kitajima et al. ..... 125/13.01

FOREIGN PATENT DOCUMENTS

JP A 11-300626 11/1999

* cited by examiner

*Primary Examiner*—Dung Van Nguyen
(74) *Attorney, Agent, or Firm*—Oliff & Berridge, PLC

(57) ABSTRACT

A grinding wheel which is to be rotated about its axis for grinding a workpiece, including: (a) a base disk; and (b) a plurality of abrasive segment chips which are fixed to the base disk such that the abrasive segment chips are arranged on a circle having a center at an axis of the base disk, and which have respective circumferential lengths as measured in a circumferential direction of the base circle, wherein the plurality of abrasive segment chips includes at least two abrasive segment chips having the respective circumferential lengths which are different from each other, and wherein the abrasive segment chips are arranged with substantially no gap between each pair of the abrasive segment chips which are contiguous to each other in the circumferential direction.

14 Claims, 5 Drawing Sheets

PRIOR ART

FIG. 7

| | | | | | | | | |
|---|---|---|---|---|---|---|---|---|
| NUMBER OF REVOLUTIONS OF REGULATING WHEEL (Index) | 1.00 | 1.02 | 1.17 | 1.18 | 1.32 | 1.33 | 1.49 | 1.50 |
| NUMBER OF LOBES (Index) | 1.00 | 0.33 | 0.85 | 0.28 | 0.25 | 0.75 | 0.22 | 0.67 |
| LOBE OCCURRENCE PERIOD (msec/lobe) | 0.219 | 0.657 | 0.221 | 0.658 | 0.657 | 0.220 | 0.657 | 0.218 |
| LOBE OCCURRENCE FREQUENCY (Hz) | 4558 | 1522 | 4524 | 1519 | 1523 | 4536 | 1522 | 4592 |
| JOINT-LINE CONTACT PERIOD (msec/chip) | 0.643 | 0.643 | 0.643 | 0.643 | 0.643 | 0.643 | 0.643 | 0.643 |
| JOINT-LINE CONTACT FREQUENCY (Hz) | 1556 | 1556 | 1556 | 1556 | 1556 | 1556 | 1556 | 1556 |
| RATIO OF LOBE OCCURRENCE FREQUENCY TO JOINT-LINE CONTACT FREQUENCY | 2.9 | 1.0 | 2.9 | 1.0 | 1.0 | 2.9 | 1.0 | 3.0 |

GRINDING WHEEL WITH ABRASIVE SEGMENT CHIPS INCLUDING AT LEAST TWO ABRASIVE SEGMENT CHIPS WHOSE CIRCUMFERENTIAL LENGTHS ARE DIFFERENT FROM EACH OTHER

BACKGROUND OF THE INVENTION

1. Field of the Invention

The present invention relates in general to a grindstone or grinding wheel, and more particularly to improvements in such a grinding wheel including a base disk and a multiplicity of abrasive segment chips which are fixed to the base disk.

2. Discussion of the Related Art

There is known a grinding wheel including: a base disk; and a multiplicity of abrasive segment chips which have respective abrasive layers and which are fixed to the base disk so as to be arranged on a circle whose center corresponds to the axis of the base disk. In a grinding operation with this grinding wheel, the base disk is rotated about the axis, so that a workpiece is ground by the abrasive layer of each abrasive segment. One example of such a grinding wheel is disclosed in JP-A-H11-300626 (publication of unexamined Japanese Patent Application laid open in 1999), in which the multiplicity of abrasive segment chips arranged on a circle are spaced apart from each other in a circumferential direction of the base disk. Due to the abrasive segment chips spaced apart from each, the rotating grinding wheel is held in intermittent contact with the workpiece during the grinding operation. In this instance, if the intermittent contact of the grinding wheel with the workpiece is made periodically, i.e., at a constant time interval between the successive contacts, the workpiece tends to suffer from a chattering or self-induced vibration, which would cause deterioration of machining accuracy in the grinding operation. In the disclosed grinding wheel, for the purpose of preventing such a deterioration of the machining accuracy due to the chattering or self-induced vibration, the abrasive segment chips are adapted to be arranged with the spacing interval between the adjacent abrasive segment chips being not constant, or alternatively, the abrasive segment chips are adapted to have respective circumferential lengths which are different from each other.

However, the above-described known grinding wheel is not capable of providing a sufficiently high machining accuracy, particularly, where it is used in an operation such as a centerless grinding operation in which a workpiece is held by a structure having a relatively low degree of rigidity, namely, where the structure to hold the workpiece does not have a rigidity high enough to avoid large amount of displacement of the workpiece which is caused by its intermittent contact with the grinding wheel.

It is considered possible to arrange the multiplicity of abrasive segment chips without a spacing interval or gap between the adjacent abrasive segment chips in the circumferential direction, so that the grinding wheel can be held in continuous or constant contact with the workpiece during the grinding operation. This arrangement, which was not known in the art at the time the present invention was made, was considered to be effective to prevent chattering of the workpiece and accordingly avoid deterioration of machining accuracy, even where the circumferential lengths of the abrasive segment chips are equal to each other.

FIG. 4 shows a grinding wheel 100, as one example having this arrangement, in which a multiplicity of arcuate abrasive segment chips 104 are disposed on an outer circumferential surface of a base disk 102 having an axis O, with substantially no gap between the abrasive segment chips 104 as viewed in a circumferential direction of the base disk 102. The arcuate abrasive segment chips 104 are bonded to each other and also to the outer circumferential surface of the base disk 102 by a suitable adhesive. Each of the abrasive segment chips 104 consists of radially inner and outer layers in the form of a support layer 104*a* and an abrasive layer 104*b* which is positioned radially outwardly of the base layer 104*a*. Each abrasive segment 104 is bonded at the support layer 104*a* to the base disk 102. Each abrasive segment 104 is brought into contact at the abrasive layer 104*b* with the workpiece during the grinding operation. The abrasive layer 104*b* is preferably formed of super abrasive grains such as diamond abrasive grains and CBN (cubic boron nitrides) abrasive grains. It is noted that each abrasive segment 104 may consist of only the abrasive layer 104*b*.

However, even such a grinding wheel having the above-described arrangement, in which the multiplicity of abrasive segment chips are arranged with substantially no gap therebetween, is not capable of satisfactorily resolving the problematic deterioration of machining accuracy, for example, when the grinding operation has to be achieved with a relatively high machining accuracy or with a machining condition that inevitably increases the chattering of the workpiece. The chattering can be caused depending upon various factors such as a machining condition and conditions of the used graining machine and grinding wheels. The possibility of chattering can be considerably increased even by a minor change in the machining condition, especially, where the grinding wheel is used in an operation such as a centerless grinding operation in which the workpiece is held by a structure having a relatively low degree of rigidity.

FIG. 5 is a view schematically illustrating a centerless grinding operation in which a cylindrical workpiece 108 is disposed on a work rest blade 106 and is gripped by and between the grinding wheel 100 and a regulating wheel 110. The workpiece 108 is rotated at a predetermined number of revolutions by the regulating wheel 110, while the grinding wheel 100 is driven to be rotated at a predetermined number of revolutions, so that an outer circumferential surface of the workpiece 108 is ground. In such a centerless grinding operation, the workpiece tends to suffer from a chattering with a higher possibility than in a grinding operation in which the workpiece is held by and between centers. The grinding operation without a chattering provides the workpiece 108 with a high degree of roundness as shown in FIG. 6A. If the workpiece 108 chatters during the grinding operation, however, a succession of large lobes 112, i.e., a succession of large protrusions and recess are formed on the outer circumferential surface in synchronization with successive occurrences of the chattering, whereby the roundness of the workpiece 108 is deteriorated as shown in FIG. 6B.

FIG. 7 is a table indicating a result of an experiment conducted by the present inventors, in which the workpiece 108 made of a bearing steel and having an outside diameter of about 10 mm was ground at its outer circumferential surface by the grinding wheel 100 having an outside diameter of about 405 mm. The number of the abrasive segment chips 104 disposed on the grinding wheel 100 was thirty three. In this centerless grinding operation as the experiment, the number of revolutions of the regulating wheel 110, i.e., the number of revolutions of the workpiece 108 was changed in steps while the number of revolutions of the grinding wheel 110 was held constant. After the grinding operation, the roundness of the workpiece 108 was evaluated by counting or measuring the number of the lobes formed on the outer circumferential surface. As is apparent from the table of FIG. 7, under conditions (which are indicated in areas defined by thick lines in the table) where the number of revolutions of the regulating wheel 110 was 1.02 times a reference value (=1.00), 1.18 times the reference value, 1.32 times the reference value and 1.49 times the reference value, the number of the lobes was reduced while each of the lobes was enlarged as shown in FIG. 6B, whereby the machining accuracy or roundness of the workpiece 108 was deteriorated. It is noted that the variation in the diametrical dimension of the workpiece 108 is somewhat exaggerated in the views of FIGS. 6A and 6B which were obtained in a roundness measuring device used in the experiment.

In the prior art, some measures against a chattering are taken as the case may be. That is, after each time the chattering occurs, the machining condition is adjusted or changed, for example, by changing the number of revolutions of the regulating wheel, or changing the height of the regulating wheel relative to the workpiece in a centerless grinding operation. However, such an adjustment as to the machining condition is not always easy to be made, particularly, in a machine shop where they work with various kinds of workpieces different in material and size from each other. Further, since such an adjustment of the machining condition generally requires a manual operation, making the adjustment frequently provides each operator with a large work load in a recent machine shop in which the number of operators is reduced owing to unmanned or automated operation. Consequently, there is a risk that a chattering having occurred suddenly is left continued with the chattering being uncared for a long time, leading to a large number of defective pieces.

In general, a chattering occurring in a machining operation sometimes originates from the condition of a machining apparatus such as a grinding machine. In the above-described experiment, however, a frequency of occurrences of the lobes 112 was about 1500 Hz (as indicated in the table of FIG. 7) which was calculated from the machining conditions such as the number of revolutions of the regulating wheel 110, while each of a grinding wheel spindle and a regulating wheel spindle of the centerless grinding machine used in the experiment had a proper vibration frequency of about 100 Hz. That is, it is considered that the lobes 112 occurring in the experiment principally originated from the grinding wheel 100 rather than from the conditions of the components of the grinding machine.

SUMMARY OF THE INVENTION

It is therefore an object of the present invention to provide a grinding wheel which has a grinding surface constituted by a multiplicity of abrasive segment chips, and which is capable of grinding a workpiece with high accuracy without suffering from chattering of the workpiece even in an operation such as a centerless grinding operation in which the workpiece is held with a relatively low degree of rigidity.

An extensive study made by the present inventor revealed that the frequency of occurrences of the lobes 112 (hereinafter simply referred to as "lobe occurrence frequency") had a high degree of correlation with a joint-line contact frequency (at which the workpiece is brought into contact with joint lines or clearances between the contiguous abrasive segment chips 104 bonded to each other) in the chattering conditions indicated in areas defined by the thick lines in the table in which the large lobes 112 occurred, in view of a ratio of the lobe occurrence frequency to the joint-line contact frequency which ratio was about 1.0 in the chattering conditions. That is, through the extensive study, the present inventors found the fact that the occurrences of the large lobes 112 due to the chattering of the workpiece 108 are minimized if the above-described joint-line contact frequency is adapted to be inconstant. It is considered that a periodic vibration, which is caused by periodic small change in a grinding load as a result of the periodic contact of the joint lines with the workpiece, cooperates with the proper vibration of the components of the grinding machine to cause a resonance vibration under the particular grinding conditions, so that the lobe occurrence frequency substantially coincided with the joint-line contact frequency. It is noted that, under the other conditions which are not indicated by the above-described thick lines in the table of FIG. 7, the ratio of the lobe occurrence frequency to the joint-line contact frequency was about 3.0, whereby the workpiece was ground without suffering from a chattering so that the number of the lobes was relatively large while each of the lobes was relatively small as shown in FIG. 6A.

The present invention was developed based on the above-described finding. The above-described object of the invention may be achieved according to any one of the first through fourteenth aspects of the invention which are described below.

The first aspect of this invention provides a grinding wheel which is to be rotated about an axis thereof for grinding a workpiece, comprising: (a) a base disk; and (b) a plurality of abrasive segment chips which are fixed to the base disk such that the abrasive segment chips are arranged in a circle having a center at an axis of the base disk, and which have respective circumferential lengths as measured in a circumferential direction of the base circle, wherein the plurality of abrasive segment chips include at least two abrasive segment chips having the respective circumferential lengths which are different from each other, and wherein the abrasive segment chips are arranged with substantially no gap between each pair of the abrasive segment chips which are contiguous to each other in the circumferential direction.

In the grinding wheel of the first aspect of the invention in which the abrasive segment chips are arranged with substantially no gap between each pair of the abrasive segment chips contiguous to each other in the circumferential direction, the workpiece is held in constant contact with the grinding wheel, rather than in intermittent contact with the grinding wheel, thereby making it possible to prevent a vibration which would be caused by the intermittent contact. Further, in contrast to the above-described grinding wheel of FIG. 4 in which the joint lines are equally spaced from each other, a spacing interval between the joint lines is inconstant owing to the arrangement in which at least two of the plurality of abrasive segment chips have the respective circumferential lengths different from each other. The inconstant spacing interval between the joint lines leads to an inconstant time interval between the successive contacts with the joint lines with the workpiece. Accordingly, the proper vibration, caused by change in a grinding load as a result of the contacts of the joint lines with the workpiece, is made unclear or indefinite, so that this vibration caused by the contacts of the joint lines with the workpiece no longer cooperates with the proper vibration of each component of the grinding machine to causes a resonance vibration, whereby a chattering due to the resonance vibration is advantageously avoided under any grinding conditions even in an operation such as a centerless grinding operation in which a workpiece is held by a structure having a relatively low degree of rigidity. Thus, even where various kinds of workpieces different in material and size from each other are used, namely, even where the machining conditions have to be frequently changed, the grinding wheel of the claimed invention is capable of performing a grinding operation with high accuracy without suffering from a chattering problem, making it possible to perform an unmanned or automated grinding operation.

It is noted that the abrasive segment chips may be fixed to an outer circumferential surface of the base disk, as in the grinding wheel of any one of the seventh through thirteenth aspects of the inventions as described below, or alternatively may be fixed to an axially end face of the base disk such that the abrasive segment chips are arranged on a circle lying on a flat face as the axially end face of the base disk. In the latter case, the grinding wheel is forced onto the workpiece in the axial direction of the grinding wheel during a grinding operation so that the workpiece is ground by a grinding surface provided by the abrasive segment chips. The grinding surface may consists of a flat surface which is held perpendicular to the axis of the grinding wheel, or may consist of a tapered surface which is inclined with respect to in a direction perpendicular to the axis of the grinding wheel.

According to the second aspect of the invention, in the grinding wheel defined in the first aspect of the invention, each pair of the abrasive segment chips are held in contact with each other. In the grinding wheel of this second aspect of the invention, each pair of the abrasive segments do not have to be held in contact with each other over an entire width of the abrasive segments, but may be held in partial contact with each other. Further, the abrasive segment chips may be fixed to the base disk by an adhesive, screws, bolts or other suitable fixing means.

According to the third aspect of the invention, in the grinding wheel defined in the first or second aspect of the invention, each pair of the abrasive segment chips are jointed together by an adhesive which is provided in a joint clearance between each pair of the abrasive segment chips.

The contiguous abrasive segment chips do not have to be necessarily held in contact with each other, as long as there is no recess between the contiguous abrasive segment chips, namely, as long as the abrasive segment chips are arranged in such a manner that avoids an intermittent contact of the grinding wheel with the workpiece which would cause a chattering of the workpiece during a grinding operation. Thus, as in the grinding wheel of this third aspect of the invention, the contiguous abrasive segment chips may be jointed through a joint portion in the form of the clearance which is filled with the boding agent.

According to the fourth aspect of the invention, in the grinding wheel defined in any one of the first through third aspects of the invention, the plurality of abrasive segment chips include a plurality of first abrasive segment chips having a first circumferential length, and a plurality of second abrasive segment chips having a second circumferential length different from the first circumferential length, and wherein the first and second abrasive segment chips are arranged such that a pitch or distance between each pair of the first abrasive segment chips which are adjacent to each other in the circumferential direction is not constant as viewed in the circumferential direction and such that a pitch or distance between each pair of the second abrasive segment chips which are adjacent to each other in the circumferential direction is not constant as viewed in the circumferential direction.

In the grinding wheel of this fourth aspect of the invention, the distance between the adjacent first abrasive segment chips and the distance between the adjacent second abrasive segment chips are not constant as viewed in the circumferential direction, namely, the first and second abrasive segment chips are arranged unevenly on the circle. For example, some of the first abrasive segment chips and some of the second abrasive segment chips may be alternately arranged, or some of the first or second abrasive segment chips may be successively arranged. In the latter case, the number of the succession of the first or second abrasive segment chips may be changed in a predetermined manner. The arrangement of the fourth aspect of the invention is effective to more reliably avoid a clear or definite proper vibration due to the contacts of the joint lines with the workpiece during one rotation of the grinding wheel in a grinding operation, thereby further effectively preventing occurrence of chattering which would be caused by the proper vibration of each component of the grinding machine.

In the grinding wheel of the fourth aspect of the invention, the first circumferential length of the first abrasive segment chips and the second circumferential length of the second abrasive segment chips are determined preferably such that a ratio of the second circumferential length to the first circumferential length is not an integer or whole number.

According to the fifth aspect of the invention, in the grinding wheel defined in the fourth aspect of the invention, the second circumferential length of the second abrasive segment chips is larger than the first circumferential length of the first abrasive segment chips, such that a ratio of the second circumferential length to the first circumferential length is larger than one and is smaller than two.

According to the sixth aspect of the invention, in the grinding wheel defined in the fifth aspect of the invention, the ratio is not smaller than 1.3 and is not larger than 1.7.

According to the seventh aspect of the invention, in the grinding wheel defined in any one of the first through sixth aspect of the invention, the plurality of abrasive segment chips are fixed to an outer circumferential surface of the base disk and have respective arcuate surfaces, and wherein the arcuate surfaces of the plurality of abrasive segment chips cooperate with each other to provide a cylindrical surface of a cylinder having a center at the axis of the base disk, so that the cylindrical surface serves as a grinding surface which is to be brought into contact with the workpiece.

According to the eighth aspect of the invention, in the grinding wheel defined in the seventh aspect of the invention, the plurality of abrasive segment chips include respective abrasive layers, and wherein the arcuate surfaces are provided by the abrasive layers.

According to the ninth aspect of the invention, in the grinding wheel defined in the eighth aspect of the invention, each of the abrasive layers is formed of abrasive grains. Each of the abrasive layers is preferably formed of super abrasive grains having a high degree of hardness such as diamond abrasive grains and CBN (cubic boron nitrides) abrasive grains. However, the abrasive layer may be formed of other abrasive grains including alumina or silicon carbide.

According to the tenth aspect of the invention, in the grinding wheel defined in the eighth or ninth aspect of the invention, the plurality of abrasive segment chips further include respective support layers each of which is positioned inwardly of a corresponding one of the abrasive layers in a radial direction of the base disk.

Each of the abrasive segment chips may be constituted only by the abrasive layer, or may be constituted by the support layer in addition to the abrasive layer as in the grinding wheel of this tenth aspect of the invention. In the latter case, the abrasive segment chip is preferably bonded, at the support layer which may be formed of a ceramic material, to the base disk.

According to the eleventh aspect of the invention, in the grinding wheel defined in any one of the seventh through tenth aspects of the invention, each of circumferentially opposite end faces of each of the abrasive segment chips is inclined with respect to a plane which passes through the above-described axis and an intersection of each of the circumferentially opposite end faces and the grinding surface.

According to the twelfth aspect of the invention, in the grinding wheel defined in the eleventh aspect of the invention, each pair of the abrasive segment chips have respective portions which are contiguous to each other in the circumferential direction and which are superposed on each other as viewed in a radial direction of the base disk.

According to the thirteenth aspect of the invention, in the grinding wheel defined in the eleventh or twelfth aspect of the invention, each of circumferentially opposite end faces of each of the abrasive segment chips has a radially inner portion and a radially outer portion which is positioned outwardly of the radially inner portion in a radial direction of the base disk, and wherein one of the radially inner and outer portions of each of circumferentially opposite end faces is positioned on a forward side of the other of the radially inner and outer portions as viewed in a rotating direction of the grinding wheel.

According to the fourteenth aspect of the invention, in the grinding wheel defined in the eleventh- or twelfth aspect of the invention, each of circumferentially opposite end faces of each of the abrasive segment chips has a radially inner portion and a radially outer portion which is positioned outwardly of the radially inner portion in a radial direction of the base disk, wherein the radially inner portion of one of the circumferentially opposite end faces is positioned on a forward side of the radially outer portion of the one of the circumferentially opposite end faces as viewed in a rotating direction of the grinding wheel, and wherein the radially inner portion of the other of the circumferentially opposite end faces is positioned on a rear side of the radially outer portion of the other of the circumferentially opposite end faces as viewed in the rotating direction of the grinding wheel.

In the grinding wheel defined in each of the seventh through fourteenth aspects of the invention, the cylindrical surface of the grinding wheel serving as the grinding surface is provided by the arcuate surfaces of the plurality of abrasive segment chips which are fixed to the outer circumferential surface of the base disk. In the grinding wheel defined in each of the eleventh through fourteenth aspects of the invention, each of the circumferentially opposite end faces of each of the abrasive segment chips is inclined with respect to the normal plane which passes through the intersection of each of the circumferentially opposite end faces and the grinding surface. This feature of each of the eleventh through fourteenth aspects of the invention can provide the arrangement that each pair of the contiguous abrasive segment chips has the respective portions which are contiguous to each other in the circumferential direction and which are superposed on each other as viewed in the radial direction of the base disk. This arrangement makes it possible to minimize the above-described joint portion or clearance between each pair of the contiguous abrasive segment chips, by pressing each abrasive segment chip onto the contiguous abrasive segment chip inwardly in the radial direction when each abrasive segment chip is fixed onto the outer circumferential surface of the base disk in an assembling process of the grinding wheel. With the joint clearances being thus minimized, it is possible to reduce the change in the grinding load as the result of the contact of the joint lines with the workpiece, whereby the proper vibration caused by the change in the grinding load can be made further unclear or indefinite.

In the grinding wheel defined in each of the seventh through fourteenth aspects of the invention, the cylindrical surface provided by the plurality of abrasive segment chips does not have to be necessarily parallel to the axis of the base disk, but may be inclined with respect to the axis so as to consist of a tapered surface. Further, while a radially outer surface of each abrasive segment chip consists of the arcuate surface, a radially inner surface of each abrasive segment chip may consist of an arcuate surface, for example, whose center is coincide with the center of the arcuate surface of the radially outer surface. The radially inner surface of each abrasive segment chip does not have to necessarily consist of the arcuate surface, but may consist of a flat surface, for example, which is perpendicular to the radial direction of the base disk. Where the radially inner surface of each abrasive segment chip consists of the flat surface, the base disk may consist of a prism member having a polygonal cross sectional shape.

The radially outer surface of each abrasive segment chip may be a flat surface before each abrasive segment chip is fixed to the base disk, so that the flat surface is formed into the arcuate surface, for example, by grinding the surface in a cylindrical grinding operation after each abrasive segment chip has been fixed to the base disk.

In the grinding wheel defined in the eleventh or twelfth aspect of the invention, the circumferentially opposite end faces of each abrasive segment chip may be inclined with respect to the respective normal lines in the same direction as in the thirteenth aspect of the invention, or may be inclined with respect to the respective normal lines in a symmetric manner, i.e., in respective directions opposite to each other as in the fourteenth aspect of the invention. In the latter case, the term "abrasive segment chips having the respective circumferential lengths different from each other" is interpreted to mean that the abrasive segment chips having the respective circumferential lengths which are different from each other as least in the radially outer surface. In other words, in the above-described latter case, the term "circumferential lengths of the abrasive segment chips" is interpreted to mean the circumferential lengths of the radially outer surfaces of the abrasive segment chips which constitute the grinding surface of the grinding wheel.

BRIEF DESCRIPTION OF THE DRAWINGS

The above and other objects, features, advantages and technical and industrial significance of this invention will be better understood by reading the following detailed description of the presently preferred embodiments of the invention, when considered in connection with the accompanying drawings, in which:

FIG. 7 is a table showing a relationship between a lobe occurrence frequency and a joint-line contact frequency (at which the workpiece is brought into contact with joint lines of the grinding wheel) under each of various numbers of revolutions of a regulating wheel.

DETAILED DESCRIPTION OF THE PREFERRED EMBODIMENT

Figure 1:
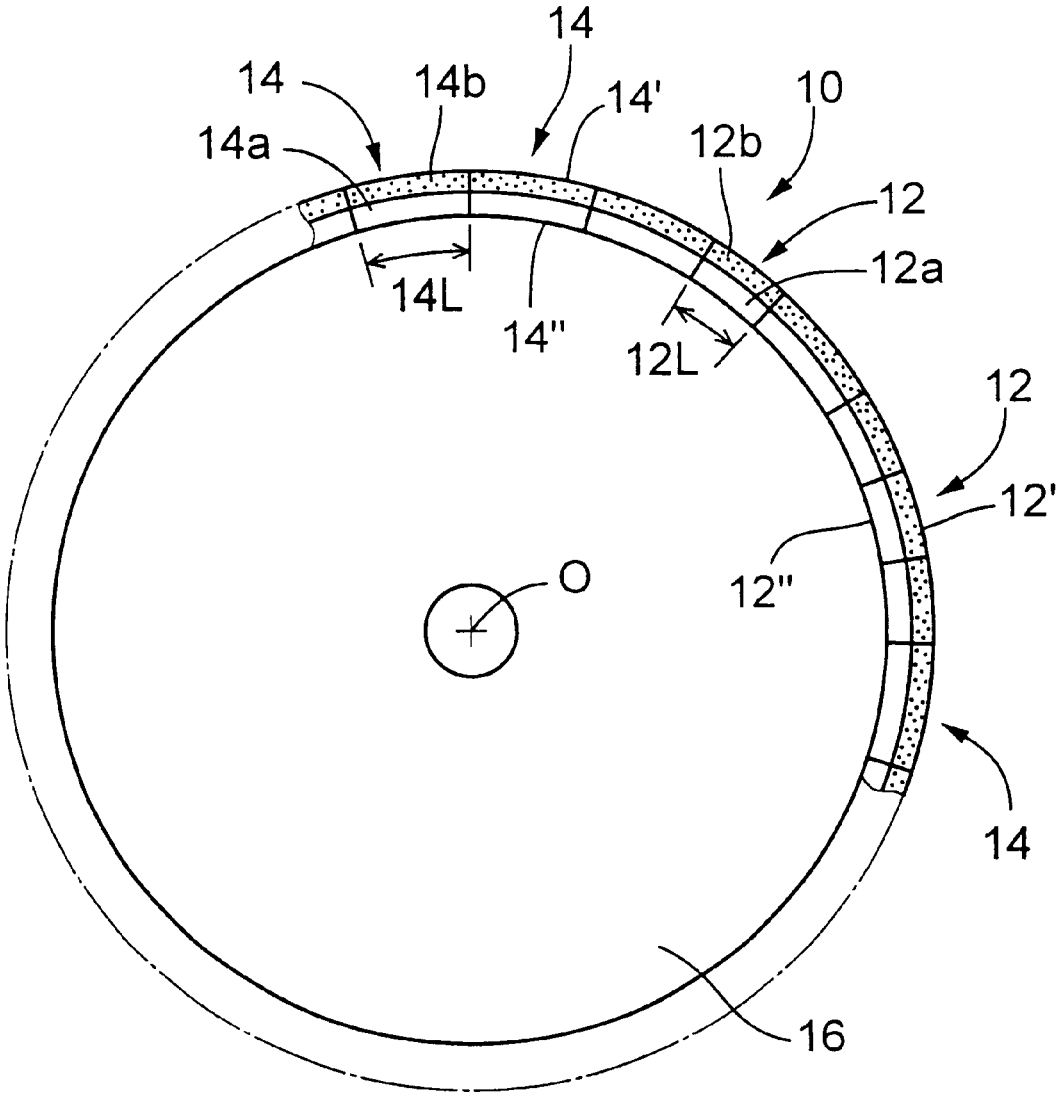
FIG. 1 is a front elevational view of a grinding wheel having a base disk and a multiplicity of abrasive segment chips fixed to the outer circumferential surface of the base disk, which wheel is constructed according to a first embodiment of the invention.

FIG. 1 is a front elevational view of a grinding wheel 10 which is constructed according to a first embodiment of the invention. The grinding wheel 10 has a base disk 16 having an axis O, and a plurality of first and second arcuate abrasive segment chips 12, 14 which are arranged on an outer circumferential surface of the base disk 16, with substantially no gap between each pair of the abrasive segment chips which are contiguous to each other as viewed in a circumferential direction of the base disk 16. The arcuate abrasive segment chips 12, 14 are bonded to the outer circumferential surface of the base disk 16 by a suitable adhesive, while each pair of the contiguous abrasive segment chips are bonded to each other by the suitable adhesive in such a manner that holds the contiguous abrasive segment chips in substantial contact with each other so as to minimize a joint clearance between each pair of the contiguous abrasive segment chips 12, 14. Each pair of the contiguous abrasive segment chips are jointed together by the adhesive which is provided in the minimized joint clearance between the contiguous abrasive segment chips. Each first abrasive segment chip 12 has a circumferential length 12L smaller than a circumferential length 14L of each second abrasive segment chip 14. Each of the arcuate abrasive segment chips 12, 14 has radially outer and inner surfaces 12', 12", 14', 14" in the form of arcuate surfaces which lay on respective circles having a common center at the axis 0 of the base disk 16. Each of the arcuate abrasive segment chips 12, 14 has a radially inner layer in the form of a base layer 12*a*, 14*a* which is bonded to an outer circumferential surface (cylindrical surface) of the base disk 16, and a radially outer layer in the form of an abrasive layer 12*b*, 14*b* which is disposed radially outwardly of the base layer 12*a*, 14*a* and which is to be brought into contact with a workpiece during a grinding operation with the grinding wheel 10. The abrasive layer 12*b*, 14*b* is formed of super abrasive grains such as diamond abrasive grains and CBN (cubic boron nitrides) abrasive grains. The radially outer surfaces of the abrasive layers 12*b*, 14*b* cooperate with each other to form a cylindrical grinding surface having a center at the axis O of the base disk 16, so that a cylindrical workpiece is ground by the cylindrical grinding surface while the grinding wheel 10 is rotated about the axis O. It is noted that the joint clearance will be also referred to as "joint line".

The circumferential length 14L of each second abrasive segment chip 14 is 1.5 times the circumferential length 12L of each first abrasive segment chip 12. The first and second abrasive segment chips 12, 14 are arranged unevenly in a circle, i.e., on the outer circumferential surface of the base disk 16. In the present embodiment, the number of the first abrasive segment chips 12 are twelve while the number of second abrasive segment chips 14 are fourteen. For example, the first and second abrasive segment chips 12, 14 may be arranged in an order of "BBABAAABBBAABBAB-BAAAAABBBB" or "ABBBAABBABBAABAABBBB-BABAAA" as viewed in the circumferential direction, where the first and second abrasive segment chips 12, 14 are represented by "A" and "B", respectively. The numbers and the arrangement order of the first and second abrasive segment chips 12, 14 are not particularly limited, as long as the twelve first abrasive segment chips 12 and the fourteen second abrasive segment chips 14 are arranged such that a pitch or distance between each pair of the first abrasive segment chips 12 which are adjacent to each other is not constant as viewed in the circumferential direction and such that a pitch or distance between each pair of the second abrasive segment chips 14 which are adjacent to each other is not constant as viewed in the circumferential direction. For example, where the grinding surface provided by the abrasive segment chips 12, 14 has a relatively large diameter, the abrasive segment chips 12, 14 may be arranged in an order of "BABABABABABBABABABABA-BAB" or "BBABAAABBBAABBABAAABBBAAB" in which the arrangement order of the first and second abrasive segment chips 12, 14 consists of two arrangement patterns identical to each other. Namely, the abrasive segment chips 12, 14 are arranged in accordance with the arrangement pattern over a 180° around the axis O, and are arranged in accordance with the same arrangement pattern over another 180° around the axis O. In this case, it can be said that the first and second abrasive segment chips 12, 14 are arranged symmetrically with respect to a center line passing through the axis O of the base disk 16. It is noted that the circumferential length 12L of each first abrasive segment chip 12 corresponds to a first circumferential length, and that the circumferential length 14L of each second abrasive segment chip 14 corresponds to a second circumferential length.

Figure 5:
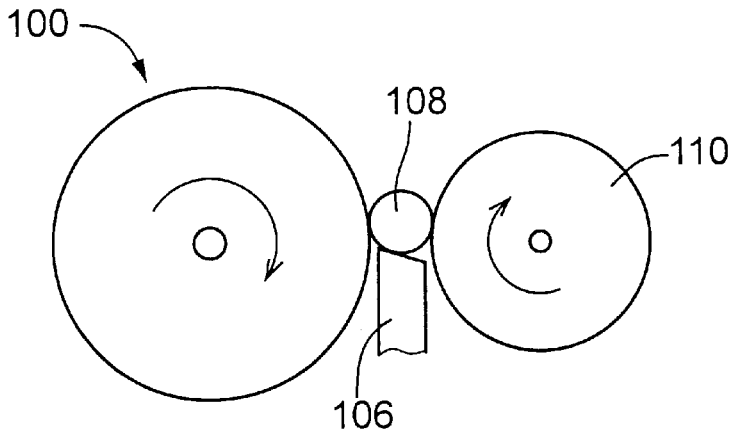
FIG. 5 is a view schematically showing a centerless grinding operation.
Figure 6A:
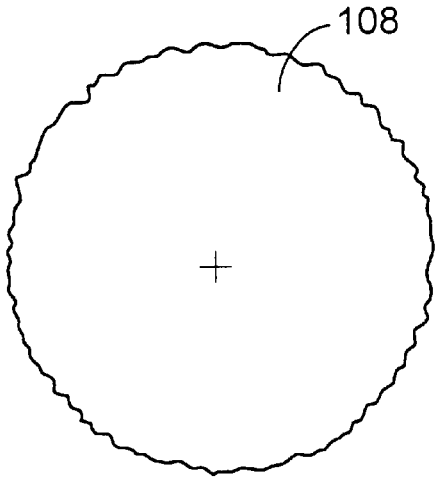
PRIOR ART FIG. 6A
FIG. 6A is a view showing a roundness of a workpiece which did not suffer from a chattering during a grinding operation.
Figure 6B:
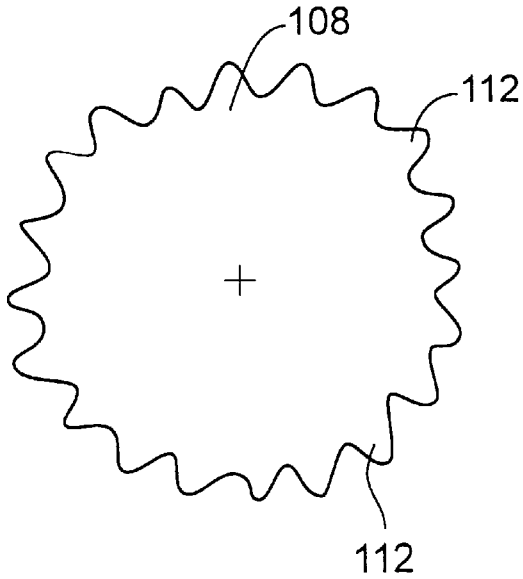
FIG. 6B is a view showing a roundness of a workpiece in which large lobes were formed in the outer circumferential surface as a result of occurrence of a chattering during a grinding operation.

The present inventors have conducted another experiment in which the grinding wheel 10 of the present embodiment of the invention was used in place of the above-described grinding wheel 100. In this experiment, like in the above-described experiment with the grinding wheel 100, the workpiece 108 is ground in a centerless grinding operation as shown in FIG. 5, with the number of revolutions of the regulating wheel 100 being changed in steps. After the grinding operation, the roundness of the workpiece 108 was evaluated by measuring the number of the lobes formed on the outer circumferential surface. According to the evaluation, even under conditions where the number of revolutions of the regulating wheel 110 was 1.02 times the reference value, 1.18 times the reference value, 1.32 times the reference value and 1.49 times the reference value, i.e., even under the conditions where the workpiece 108 suffered from a chattering in the above-described experiment with the grinding wheel 100, the workpiece 108 did not suffer from a chattering. In this experiment with the grinding wheel 10 of the present embodiment of the invention, the workpiece 108 was freed from a chattering and exhibited a lob frequency (msec/lobe) was about 0.22 under any machining conditions. It is noted that the grinding wheel 10 has an outside diameter of about 405 mm as the grinding wheel 100, and that each first abrasive segment chip 12 which is smaller than each second abrasive segment chip 14 is identical with each abrasive segment chip 104.

Figure 4:
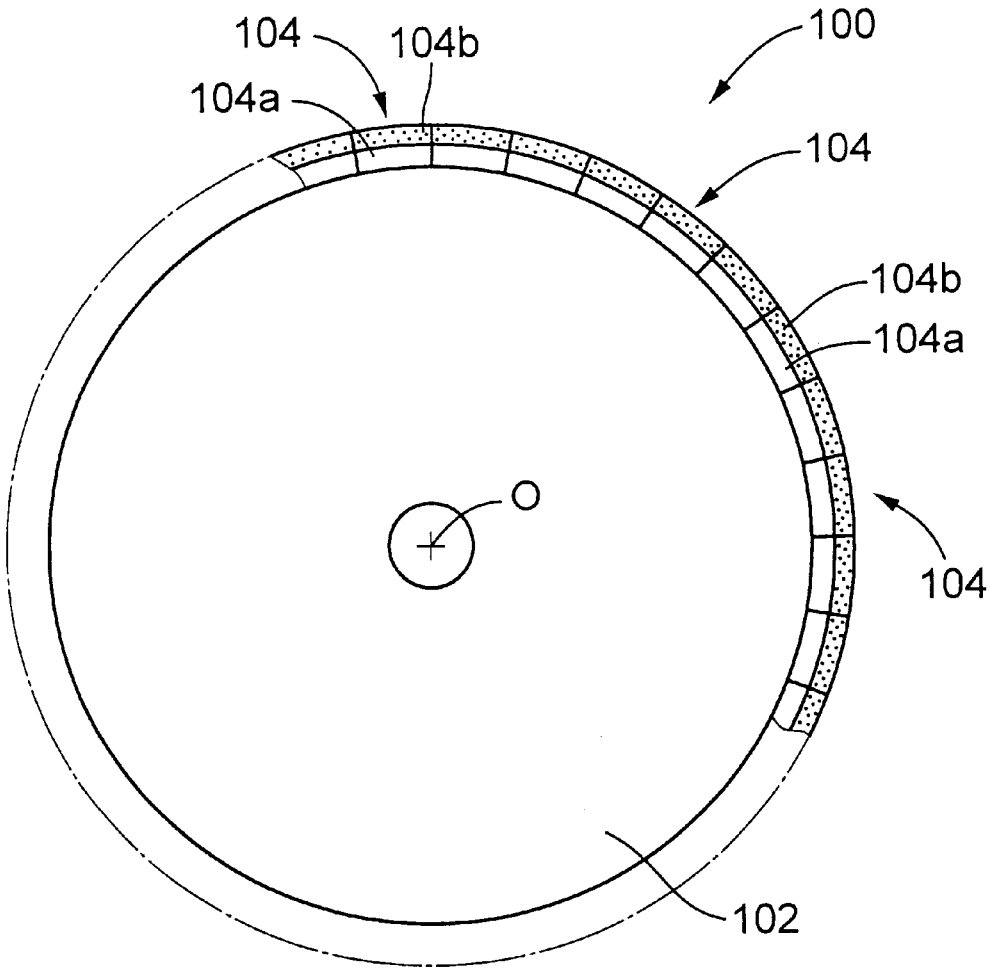
FIG. 4 is a front elevational view of a grinding wheel in which the abrasive segment chips have the same circumferential length and are arranged with substantially no gaps between each pair of abrasive segment chips contiguous to each other.

In the grinding wheel 10 constructed according to the present embodiment of the invention in which the abrasive segment chips 12, 14 are arranged with substantially no gap between each pair of the abrasive segment chips contiguous to each other in the circumferential direction, the workpiece is held in constant contact with the grinding wheel 10, rather than in intermittent contact with the grinding wheel 10, thereby making it possible to prevent a vibration which would be caused by the intermittent contact. Further, in contrast to the above-described grinding wheel 100 of FIG. 4 in which the joint lines between the contiguous abrasive segment chips 104 are equally spaced from each other, a spacing interval between the joint lines as viewed in the circumferential direction is inconstant owing to the arrangement in which each first abrasive segment chip 12 and each second abrasive segment chip 14 have the respective circumferential lengths different from each other. The inconstant spacing interval between the joint lines leads to an inconstant time interval between the successive contacts of the joint lines with the workpiece. Accordingly, the proper vibration, caused by change in a grinding load as a result of the contacts of the joint lines with the workpiece, is made unclear or indefinite. Further, in the grinding wheel 10 of this embodiment of the invention, since the distance between the adjacent first abrasive segment chips 12 and the distance between the adjacent second abrasive segment chips 14 are not constant as viewed in the circumferential direction, it is possible to avoid a clear or definite proper vibration due to the contacts of the joint lines with the workpiece during each rotation of the grinding wheel 10 in a grinding operation.

Therefore, the vibration caused by the contacts of the joint lines with the workpiece no longer cooperates with the proper vibration of each component of the grinding machine to causes a resonance vibration, whereby a chattering due to the resonance vibration is advantageously avoided under any grinding conditions even in an operation such as a centerless grinding operation in which a workpiece is held by a structure having a relatively low degree of rigidity. Thus, even where various kinds of workpieces different in material and size from each other are used, i.e., even where the machining conditions have to be frequently changed, the grinding wheel of the claimed invention is capable of performing a grinding operation with high accuracy without suffering from a chattering problem, making it possible to perform an unmanned or automated grinding operation.

Figure 2:
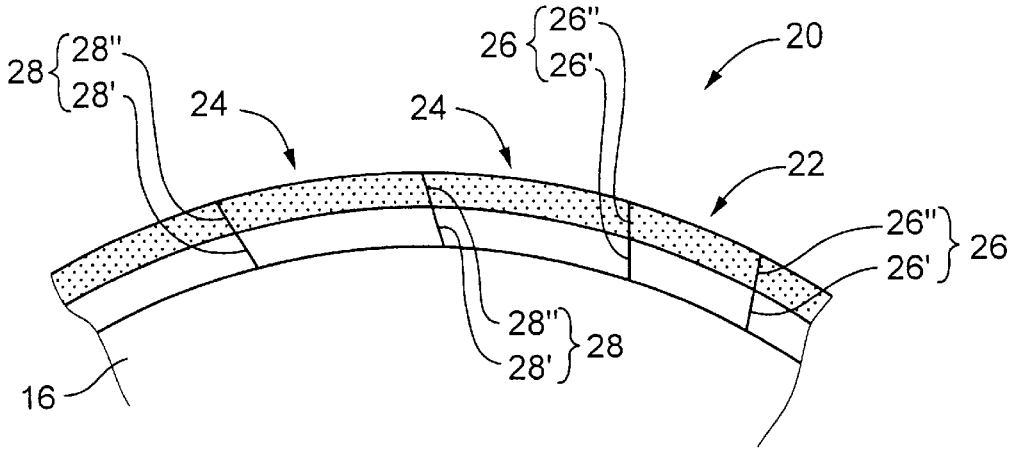
FIG. 2 is a view of a part of a grinding wheel which is constructed according to a second embodiment of the invention.

FIG. 2 shows a grinding wheel 20 which is constructed according to a second embodiment of the invention. This grinding wheel 20 is different from the above-described grinding wheel 10 in shapes of first and second arcuate abrasive segment chips 22, 24 which are fixed to the outer circumferential surface of the base disk 16. Each of circumferentially opposite end faces 26, 28 of each of the arcuate abrasive segment chips 22, 24 are inclined with respect to a normal plane which passes thorough an intersection of the corresponding circumferentially end face 26, 28 and the cylindrical grinding surface and which is perpendicular to a tangent plane tangent to the intersection, i.e., with respect to a plane which passes through the intersection and the axis O. In this second embodiment, the circumferentially opposite end faces 26, 28 are inclined with the respect to the respective normal planes by the same degree of angle in the same direction, so that each pair of the abrasive segment chips which are contiguous to each other have respective superposed portions superposed on each other in a radial direction of the base disk 16. Described more specifically, each of the circumferentially opposite end faces 26, 28 of each of the abrasive segment chips 22, 24 has a radially inner portion 26', 28' and a radially outer portion 26 ", 28" which is positioned outwardly of the radially inner portion 26', 28' in the radial direction and which is positioned on a rear side of the radially inner portion 26', 28' as viewed in the clockwise direction as seen in FIG. 2, so that the superposed portion of a forward one of each pair of the contiguous abrasive segment chips is positioned radially outwardly of the superposed portion of a rear one of the corresponding pair of the contiguous abrasive segment chips.

This arrangement makes it possible to minimize the above-described joint portion or clearance between each pair of the contiguous abrasive segment chips, by pressing each abrasive segment chip onto the contiguous abrasive segment chip inwardly in the radial direction when each abrasive segment chip is fixed onto the outer circumferential surface of the base disk 16 in an assembling process of the grinding wheel 20. With the clearances being thus minimized, it is possible to reduce the change in the grinding load as the result of the contact of the joint lines with the workpiece, whereby the proper vibration caused by the change in the grinding load can be made further unclear or indefinite.

Figure 3:
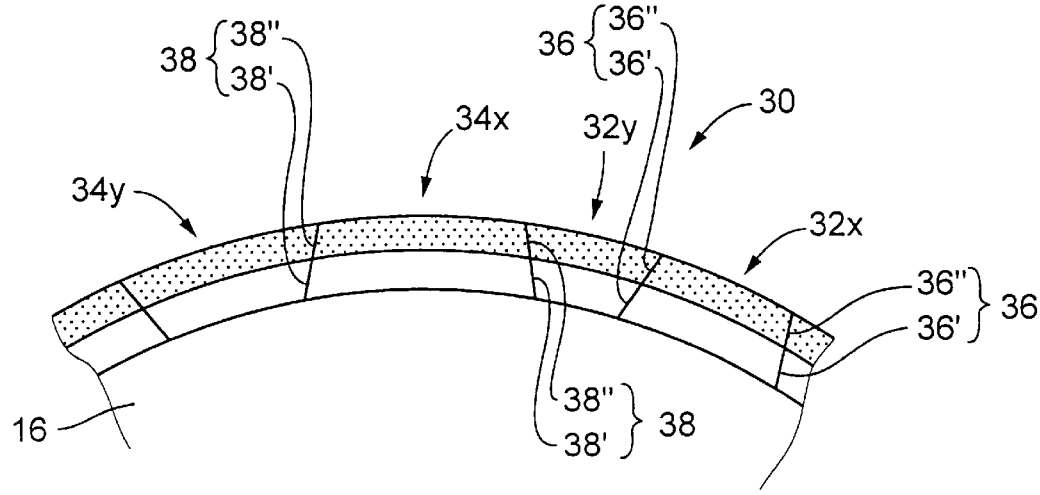
FIG. 3 is a view of a part of a grinding wheel which is constructed according to a third embodiment of the invention.

FIG. 3 shows a grinding wheel 30 which is constructed according to a third embodiment of the invention. While the circumferentially opposite end faces 26, 28 of the abrasive segment chips 22, 24 are inclined with the respect to the respective normal planes by the same degree of angle in the same direction in the above-described grinding wheel 20, the circumferentially opposite end faces 36, 38 of the abrasive segment chips 32*x*, 32*y*, 34*x*, 34*y* are inclined with respect to the respective normal planes in opposite directions, i.e., in a symmetrical manner in this grinding wheel 30. Described more specifically, the circumferential length of each of the abrasive segment chips 32*x*, 34*x* is gradually increased as viewed in a radial direction away from the grinding surface toward the axis O, while that of each of the abrasive segment chips 32*y*, 34*y* is gradually increased as viewed in a radial direction away from the axis O toward the grinding surface. Each of the circumferentially opposite end faces 36, 38 of each of the abrasive segment chips 32*x*. 32*y*. 34*x*. 34*y* has a radially inner portion 36', 38' and a radially outer portion 36", 38" which is positioned outwardly of the radially inner portion 36', 38' in a radial direction of the base disk 16. The radially inner portion 36', 38' of one of the circumferentially opposite end faces 36, 38 is positioned on a forward side of the radially outer portion 36", 38" of the one of the circumferentially opposite end faces 36, 38 as viewed in a rotating direction of the grinding wheel 30. The radially inner portion 36', 38' of the other of the circumferentially opposite end faces 36, 38 is positioned on a rear side of the radially outer portion 36", 38" of the other of the circumferentially opposite end faces 36, 38 as viewed in the rotating direction of the grinding wheel 30. The abrasive segment chips 32*x*, 32*y* are identical with each other and with the abrasive segment chips 12, 22 of the above-described grinding wheels 10, 20, in the circumferential length as measured along the grinding surface, which length is one of factors of the above-described joint-line contact frequency. Similarly, the abrasive segment chips 34*x*, 34*y* and the abrasive segment chips 14, 24 of the above-described grinding wheels 10, 20 have the same circumferential length as measured along the grinding surface. Although the circumferentially opposite end faces 36, 38 of each of the abrasive segment chips 32*x*, 32*y*, 34*x*, 34*y* are inclined with respect to the respective normal planes in the opposite directions, the absolute values of angles of the inclinations of the circumferentially opposite end faces 36, 38 with respect to the respective normal planes are equal to each other. Each abrasive segment chip 32*x* or 34*x* and each abrasive segment chip 32*y* or 34*y* are alternately arranged such that each pair of the contiguous abrasive segment chips are held at the respective circumferentially end faces in substantially close contact with each other. This grinding wheel 30 provides the same technical advantage as the above-described grinding wheel 20.

While the presently preferred embodiments of the present invention have been illustrated above, it is to be understood that the invention is not limited to the details of the illustrated embodiments, but may be embodied with various other changes, modifications and improvements, which may occur to those skilled in the art, without departing from the spirit and scope of the invention defined in the following claims.

What is claimed is:

1. A grinding wheel which is to be rotated about an axis thereof for grinding a workpiece, comprising:

a base disk; and a plurality of abrasive segment chips which are fixed to said base disk such that said abrasive segment chips are arranged on a circle having a center at an axis of said base disk, and which have respective circumferential lengths as measured in a circumferential direction of said base circle, wherein said plurality of abrasive segment chips include at least two abrasive segment chips having the respective circumferential lengths which are different from each other, and wherein said abrasive segment chips are arranged with substantially no gap between each pair of said abrasive segment chips which are contiguous to each other in said circumferential direction.

2. A grinding wheel according to claim 1, wherein said each pair of said abrasive segment chips are held in contact with each other.

3. A grinding wheel according to claim 1, wherein said each pair of said abrasive segment chips are jointed together by an adhesive which is provided in a joint clearance between said each pair of said abrasive segment chips.

4. A grinding wheel according to claim 1, wherein said plurality of abrasive segment chips include a plurality of first abrasive segment chips having a first circumferential length, and a plurality of second abrasive segment chips having a second circumferential length different from said first circumferential length, and wherein said first and second abrasive segment chips are arranged such that a distance between each pair of said first abrasive segment chips which are adjacent to each other in said circumferential direction is not constant as viewed in said circumferential direction and such that a distance between each pair of said second abrasive segment chips which are adjacent to each other in said circumferential direction is not constant as viewed in said circumferential direction.

5. A grinding wheel according to claim 4, wherein said second circumferential length of said second abrasive segment chips is larger than said first circumferential length of said first abrasive segment chips, such that a ratio of said second circumferential length to said first circumferential length is larger than one and is smaller than two.

6. A grinding wheel according to claim 5, wherein said ratio is not smaller than 1.3 and is not larger than 1.7.

7. A grinding wheel according to claim 1, wherein said plurality of abrasive segment chips are fixed to an outer circumferential surface of said base disk and have respective arcuate surfaces, and wherein said arcuate surfaces of said plurality of abrasive segment chips cooperate with each other to provide a cylindrical surface of a cylinder having a center at said axis of said base disk, so that said cylindrical surface serves as a grinding surface which is to be brought into contact with said workpiece.

8. A grinding wheel according to claim 7, wherein said plurality of abrasive segment chips include respective abrasive layers, and wherein said arcuate surfaces are provided by said abrasive layers.

9. A grinding wheel according to claim 8, wherein each of said abrasive layers is formed of abrasive grains.

10. A grinding wheel according to claim 8, wherein said plurality of abrasive segment chips further include respective support layers each of which is positioned inwardly of a corresponding one of said abrasive layers in a radial direction of said base disk.

11. A grinding wheel according to claim 7, wherein each of circumferentially opposite end faces of each of said abrasive segment chips is inclined with respect to a plane which passes through said axis and an intersection of said each of the circumferentially opposite end faces and said grinding surface.

12. A grinding wheel according to claim 11, wherein said each pair of said abrasive segment chips have respective portions which are contiguous to each other in said circumferential direction and which are superposed on each other as viewed in a radial direction of said base disk.

13. A grinding wheel according to claim 11, wherein said each of circumferentially opposite end faces of each of said abrasive segment chips has a radially inner portion and a radially outer portion which is positioned outwardly of said radially inner portion in a radial direction of said base disk, and wherein one of said radially inner and outer portions of said each of circumferentially opposite end faces is positioned on a forward side of the other of said radially inner and outer portions as viewed in a rotating direction of said grinding wheel.

14. A grinding wheel according to claim 11, wherein said each of circumferentially opposite end faces of each of said abrasive segment chips has a radially inner portion and a radially outer portion which is positioned outwardly of said radially inner portion in a radial direction of said base disk, wherein said radially inner portion of one of said circumferentially opposite end faces is positioned on a forward side of said radially outer portion of said one of said circumferentially opposite end face as viewed in a rotating direction of said grinding wheel, and wherein said radially inner portion of the other of said circumferentially opposite end faces is positioned on a rear said of said radially outer portion of said other of said circumferentially opposite end faces as viewed in the rotating direction of said grinding wheel.

* * * * *